US009828801B1

(12) United States Patent
Abbisso

(10) Patent No.: US 9,828,801 B1
(45) Date of Patent: Nov. 28, 2017

(54) LADDER WITH SAFETY DEVICE

(71) Applicant: Leonard J Abbisso, Dedham, MA (US)

(72) Inventor: Leonard J Abbisso, Dedham, MA (US)

( * ) Notice: Subject to any disclaimer, the term of this patent is extended or adjusted under 35 U.S.C. 154(b) by 0 days.

(21) Appl. No.: 14/883,761

(22) Filed: Oct. 15, 2015

(51) Int. Cl.
*E06C 7/00* (2006.01)

(52) U.S. Cl.
CPC ..... *E06C 7/006* (2013.01)

(58) Field of Classification Search
CPC ..... E06C 7/006
See application file for complete search history.

(56) References Cited

U.S. PATENT DOCUMENTS 3,965,960 A * 6/1976 Massey ..... A47K 3/38 160/11
4,126,206 A 11/1978 Becnel
5,350,229 A * 9/1994 Smed ..... A47B 88/00 312/333
5,421,428 A 6/1995 Ingles
5,441,126 A 8/1995 Orrick
5,547,080 A * 8/1996 Klimas ..... B25H 3/02 182/129
5,575,353 A * 11/1996 Cafaro ..... E06B 9/02 160/24
7,717,231 B2 5/2010 Horton
8,851,233 B2 * 10/2014 Murphy ..... E06C 1/383 182/160
2013/0117923 A1 * 5/2013 Toner ..... E04H 4/144 4/504
2015/0368968 A1 * 12/2015 Smith ..... E06B 9/50 160/311

OTHER PUBLICATIONS

UNK, Ladder-Shield, Catalog, Sep. 26, 2015, accuform.com/uc/ladder-sheild-klb426, Accuform, US.

* cited by examiner

*Primary Examiner* — Alvin Chin-Shue
(74) *Attorney, Agent, or Firm* — Stan Collier, Esq.

(57) ABSTRACT

The ladder safety device is for blocking access to the lower rungs of a portable extension ladder. During use, the ladder may have to remain positioned against a structure in that it is part of the temporary scaffolding or for other reasons. In one embodiment, a container having a width slightly less than the width between the side rails is positioned on a higher rung by a pair of hooks. A slot in the container has one end of a flexible panel extending therefrom with hooks thereon. The panel is unwound upon a controllable shaft when pulled from the container and the lower hooks are attached to a lower rung. A locking device must be activated to allow for the removal of the lower hooks and then the retraction of the panel into the container. The device may be incorporated into the rung.

3 Claims, 7 Drawing Sheets

LADDER WITH SAFETY DEVICE

CROSS-REFERENCES TO RELATED APPLICATIONS

NA

REFERENCE TO FEDERALLY SPONSORED RESEARCH OR DEVELOPMENT

NA

REFERENCE TO JOINT RESEARCH AGREEMENTS

NA

REFERENCE TO SEQUENCE LISTING

NA

BACKGROUND OF THE INVENTION

Field of the Invention

The present invention generally relates to devices for climbing, and, in particular, relates to ladders, and, in greater particularity, relates to devices for preventing unauthorized climbing thereon.

Description of the Prior Art

The use of devices for accessing heights above one's reach are well known. This problem occurs both in a residential and construction settings. One device of general use is the folding step ladder or extension ladder. The typical extension ladder is made of aluminum, but fiberglass is also used. The extension ladder combines two sliding sections together. The extension ladder is about 1.5 feet in width, can range in height up to 30 or more feet, and with rungs about 1 foot apart. When left in the standing position, it presents an attractive nuisance to children, in particular, but others may attempt to use the ladder to gain access to a building and remove construction materials. This problem has been addressed by several devices as noted below.

The Accuform Signs ladder shield kit shows a flexible panel secured to ladder rungs by a cable and lock through grommets in the panel back. The panel rolls up on itself when not in use.

Several Patents Address this Problem:

U.S. Pat. No. 7,717,231 shows a ladder guard having a plurality of panels that overlap to prevent the use of the rungs and can be adjusted to allow the use of the rungs. It is connected to the ladder when not in use. The additional weight at one end of the ladder may cause it to become unstable when being moved.

U.S. Pat. No. 5,575,353, although not being a ladder invention, shows a device like for use in blocking the use of stairs in a house with a flexible sheet thereon deployed therefrom. Adjustable rods like in shower curtains allow for placement on stair side rails of varying widths.

U.S. Pat. No. 5,441,126 shows a semi-rigid shell placed over the front of extension ladder sections and temporarily deployed thereon.

U.S. Pat. No. 5,421,428 shows a metal sheet covering rungs and hooked over a top and bottom rung.

U.S. Pat. No. 4,126,206 shows two sheets placed over rungs and locked thereto to prevent access.

All references are incorporated herein as to their teachings.

Accordingly, there is a need for a device for use upon extension ladders that is readily available for use and can be stored thereon without interference with climbing thereon.

SUMMARY OF THE INVENTION

The present invention is directed at extension ladders and preventing access thereon when setup.

The present invention in one embodiment provides a portable ladder safety device for blocking access to the lower rungs of a portable extension ladder. During use, the ladder may have to remain positioned against a structure in that it is part of the temporary scaffolding or left in position for other reasons. Once the ladder is positioned, the portable ladder safety device is used as necessary. The ladder safety device may be permanently attached or removable when not in use. A container thereof has a pair of hooks that are placed over an upper rung. A flexible panel is pulled from the container onto and over the exposed lower rungs and a pair of lower hooks are attached to a lower rung that are permanently attached to the lower end of the panel. The flexible panel automatic retracts to remove any excess panel. A locking mechanism in the container prevents the panel from being removed or moved once locked.

In another embodiment, the container may be attached to an upper run by the manufacturer of the ladder and sold as a unit thereon. It may also be an integral part of a ladder rung. The container would have a width slightly less than the width between the side rails. A slot in the container has one end of a flexible panel extending therefrom with hooks thereon. The panel is unwound upon a controllable and lockable shaft when pulled from the container and the lower hooks are attached to a lower rung. A release device must be activated to allow for the removal of the lower hooks and then the retraction of the panel into the container.

One object of the present invention is to provide a ladder safety device to prevent unauthorized access to a setup ladder.

It is another object of the present invention to provide a ladder safety device that is a separately purchased unit and attached to the ladder when used and as needed.

It is a further object of the present invention to provide a ladder safety device that is attached to a purchased ladder.

It is still a further object of the present invention to provide a ladder safety device that is secured by a lock.

It is yet a further object of the present invention to provide a ladder safety device that further may have warnings and advertisement thereon.

It is yet a further object of the present invention to provide a ladder safety device that employs the use of a rotatable biased shaft or a manually turned shaft having the panel thereon.

These and other objects, features, and advantages of the present invention will become more readily apparent from the attached drawings and the detailed description of the preferred, embodiments, which follow.

BRIEF DESCRIPTION OF THE DRAWINGS

Like reference numerals refer to like parts throughout the several views of the drawings.

DETAILED DESCRIPTION OF THE PREFERRED EMBODIMENTS

The present invention provides a ladder safety device for preventing the unauthorized access to a positioned ladder.

In general, the present invention in one embodiment provides a portable ladder safety device for blocking access to the lower rungs of a portable extension ladder. Once the ladder is positioned, the portable ladder safety device is attached. A container of the ladder safety device has a pair of hooks that are placed over an upper rung. A flexible panel, is pulled from the container onto and over the exposed lower rungs and a pair of lower hooks are attached to a lower rung. The flexible panel may automatically retract to remove any excess panel or is manually moved. A locking mechanism in the container prevents the panel from being removed thereafter.

In general, in another embodiment, the container is attached to an upper rung by the manufacturer of the ladder and sold as a unit thereon. It may also be an integral part of a ladder rung. The container would have a width slightly less than the width between the side rails. A slot in the container has one end of a flexible panel extending therefrom with hooks thereon. The panel may be unwound upon a controllable, spring biased, and lockable shaft when pulled from the container and the lower hooks are attached to a lower rung. The panel itself may be made of fabric, plastic or metal and have a length approximately of about 5 feet. A release device must be activated to allow for the removal of the lower hooks and then the retraction of the panel into the container.

Figure 1:
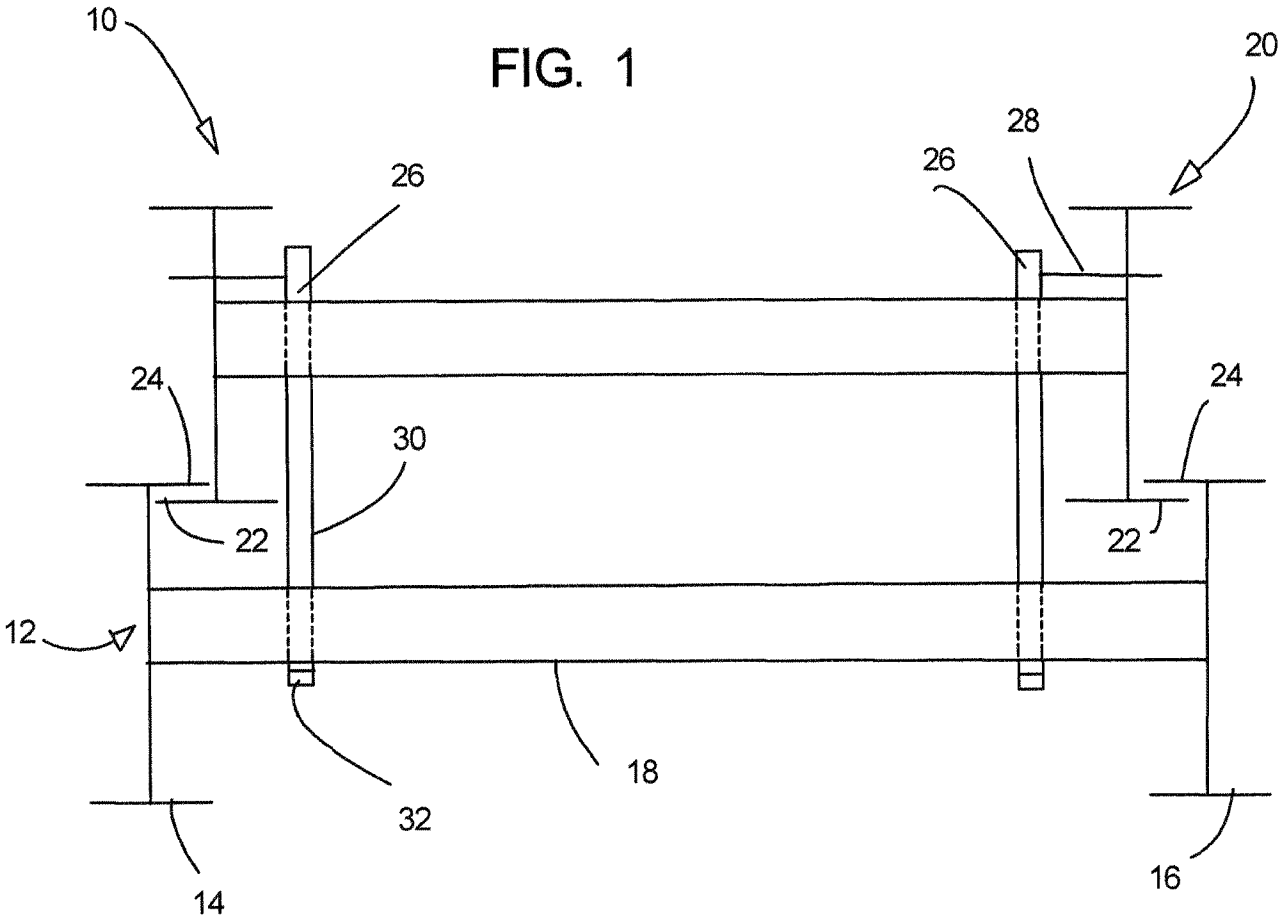
FIG. 1 is a cross sectional view transverse to the extension ladder length showing two ladder sections in sliding engagement and the two extension locking members.
Figure 2:
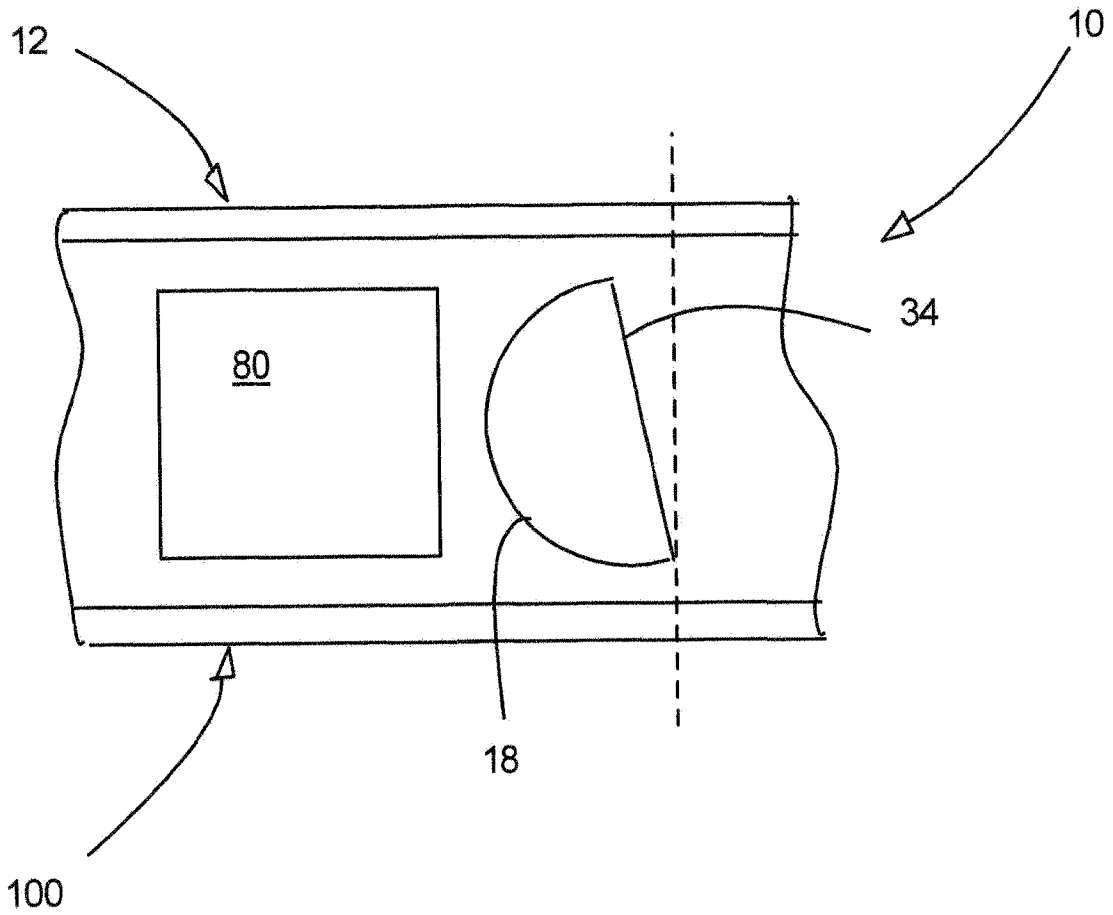
FIG. 2 is a cross sectional view horizontally through a ladder rung.

Referring to FIG. 1, an extension ladder 10 is of conventional design and shown in traverse cross section. The extension ladder 10 may be made of aluminum or fiberglass. The invention further may be adapted to a folding step ladder. The ladder 10 has a first ladder section 12 that normally rests upon the ground or other solid object when positioned. The side rails 14 and 16 are "I" shaped with a rung 18 therebetween. Attached to the first ladder section 12 is a second ladder section 20 of similar design by the outside edges 22 are in sliding engagement/attachment to the first ladder section 12. The edges 22 are positioned under the inside edges 24 of the first ladder section 12. Slide locks 26 being two rotate upon pins 28. A lower edge 30 of the slide lock 26 has a lip 32 that fits over a rung 18. This prevents the second ladder section 20 from sliding downward when stood upright. To move the second ladder section 20 higher, the second ladder section 20 is moved slightly upwards so that the slide locks 26 can be rotated away so that the lips 32 are not engaged with the rung 18. When released, the slide locks 26 rotate inward and will engage the rung as it is lowered. FIG. 2 is a longitudinal cross section through one rung 18 and shows the rung slanted side 34 for a footstep. The operation of the extension ladder 10 is well known to one skilled in the art.

Figure 3:
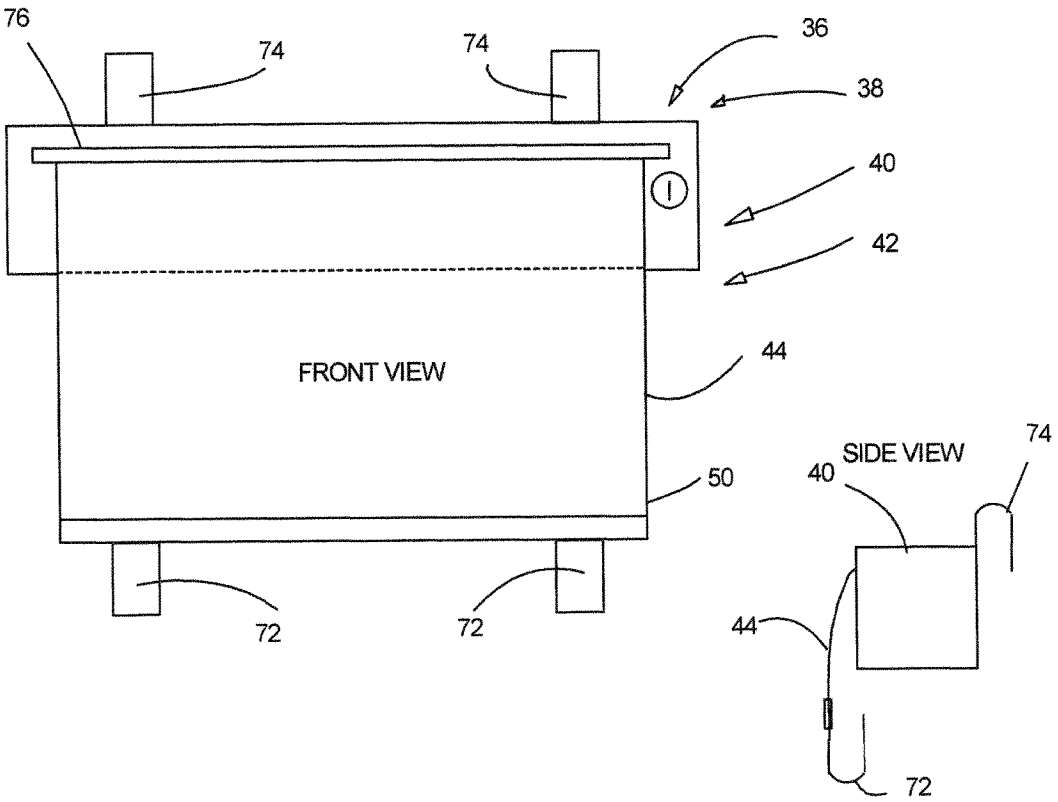
FIG. 3 is a front view of the ladder safety device with the flexible panel therein.

FIG. 3 shows a front view and a side view of the ladder safety device 36 having means for connecting 38 the ladder safety device 36 to a ladder 10; the ladder safety device 36 has a container 40 with a flexible panel therein or which can be unreeled therefrom. The container 40 would be made of metal or plastic and shaped as a rectangular or cylindrical container. The flexible panel 44 may be about 12 inches wide or so, made of a fabric like canvas, plastic or metal, and with a length of about five feet. The container 40 in FIG. 3 has a traverse slot 76 therein from which the flexible panel 44 extends. Within the container 40 is a lockable means 42, FIG. 4, mounted therein for controlling the flexible panel 44. A rotatable biased shaft 46, FIG. 5, may also be mounted in the container 40 and the flexible panel 44 has on one end mounted to the rotatable biased shaft 46 with the lockable means 42 engaging the rotatable biased shaft 46 in a predetermined manner as shown in FIG. 4 and is typically mounted on one end of the rotatable based shaft 46.

Figure 7:
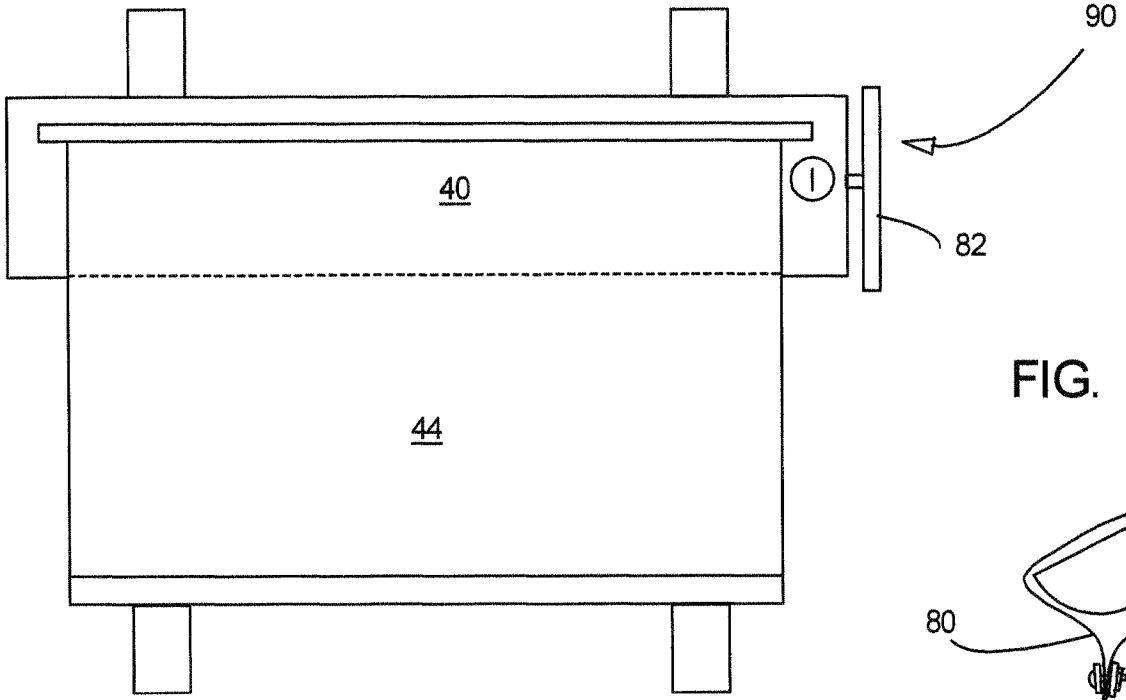
FIG. 7 illustrates a manual wheel that may be used to retract the panel.

FIG. 7 illustrates an embodiment where the rotatable biased shaft 46 is replaced by a manually turned shaft 80 wherein an external wheel 82 may be rotated. The shaft 80 is also engaged with a lockable means 42 as described below.

Figure 4:
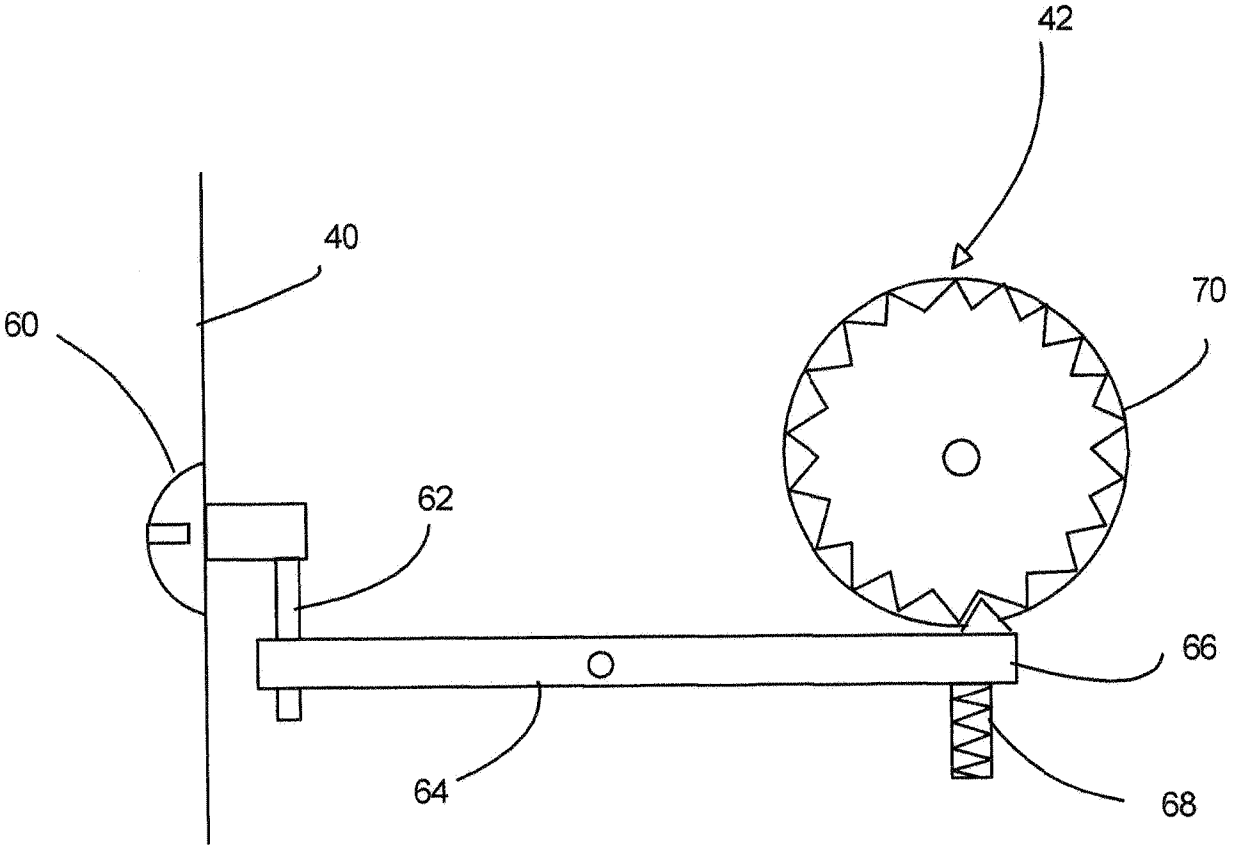
FIG. 4 is a top view of a locking device to control the panel release and retraction.
Figure 5:
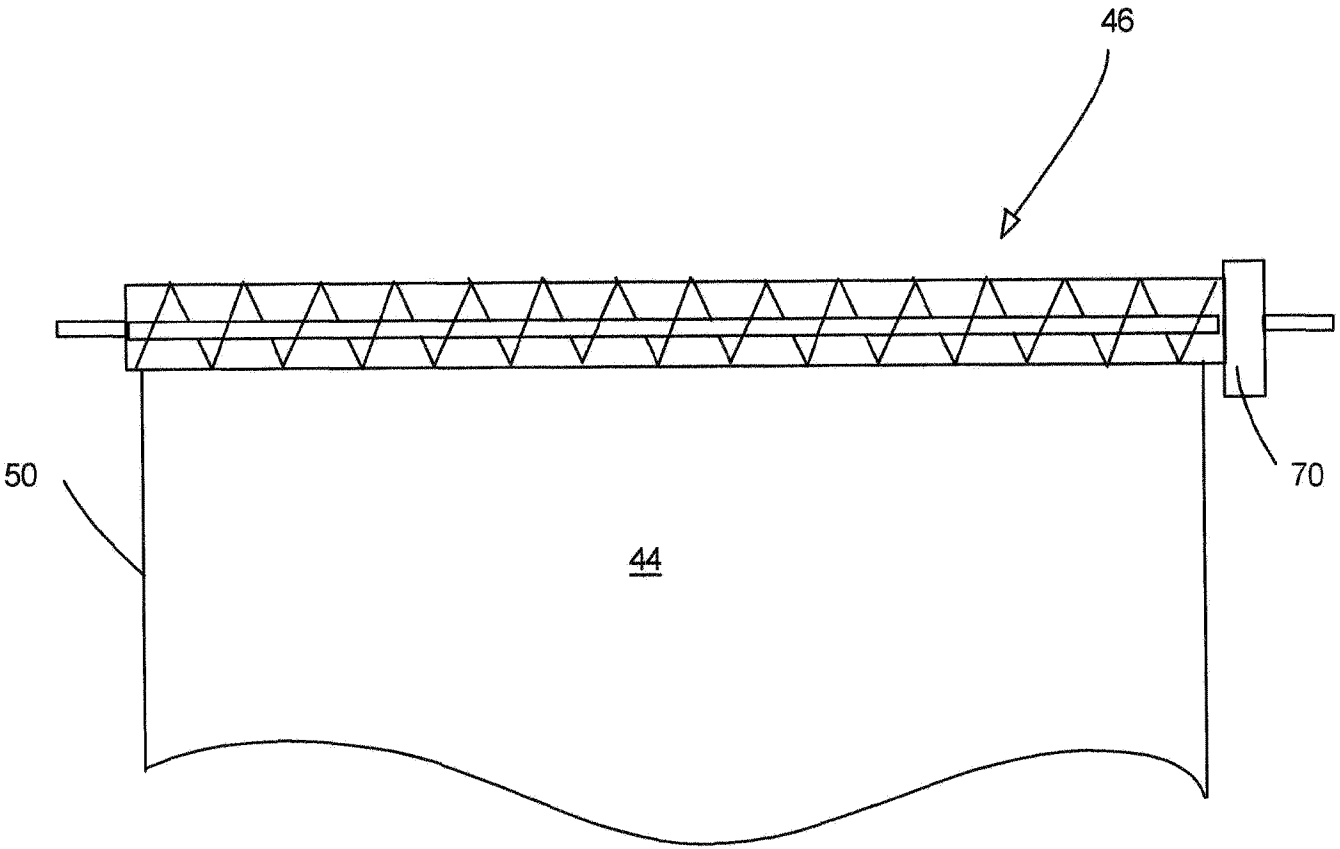
FIG. 5 is top view of a rotatable biased shaft.

FIG. 4 illustrates a lockable means 42. A keyed lock 60 is mounted in the container 40. When the key, not shown, is turned counterclockwise, a lever 62 rotates upward against a pivoted shaft/arm 64. The pivoted shaft/arm 64 is spring biased by spring 68 so that teeth 66 are normally engaged to a geared wheel 70 to prevent rotation. When the pivoted shaft/arm 64 rotates downward, the teeth 66 disengage from the wheel 70 and due to a spring bias of the rotatable biased shaft 46, FIG. 5, the rotatable biased shaft 46 will always turn in a rotation to retract the panel if there are no forces counter the rotation such as a pulling action upon the panel 44. After the lower hooks 72 are secured to a lower rung, the key is rotated clockwise so that the geared wheel 70 will not rotate further. At that point the panel 44 is pulled tight and can not be removed since the geared wheel 70 is held by the teeth 66. To release the panel 44, the key is again turned counter clockwise which allows the rotatable shaft 46 to rotate. The hooks 72 are pulled off of the rung and this allows the panel 44 to be retracted into the housing 40. The ladder safety device can then be removed from the ladder. It is further possible to have the ladder safety device mounted on a lower rung and have the flexible panel 44 extend upwards.

The ladder safety device is used upon an extension ladder 10, but can be adapted for use on other types of ladders.

Figure 6:
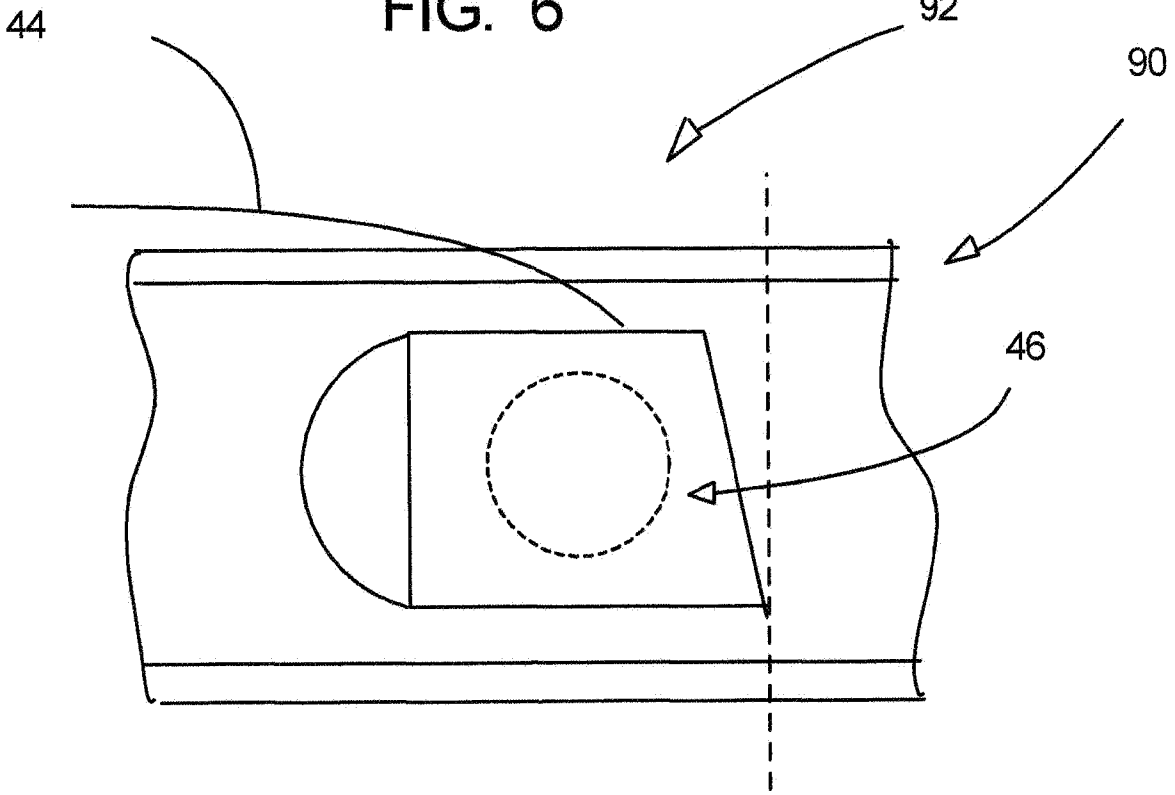
FIG. 6 illustrates an embodiment where the ladder safety device is a part of a rung.

In the first embodiment, the ladder safety device 36 connects to rung 18 of the ladder 10; in another embodiment, the ladder safety device 100 is attached to a side rails 14 and 16 of the ladder 100, FIG. 2, and in a third embodiment, FIG. 6, the ladder safety device 90 may be an integral part of a rung 92.

In the first embodiment, the ladder safety device has means for connecting to the ladder 10 via hooking means. The hooking means comprises a first hooking means mounted on said container 40, and a second hooking means mounted on the flexible panel 44 on an end opposite to the end mounted to the rotatable biased shaft 46. In the first embodiment, the hooking means are a pair of hooks 74 on the container 40 and a pair of hooks 72 on the panel 44. It should be understood that the ladder safety device may be mounted opposite to that discussed, for example, having the flexible panel extend upwards instead.

The rotatable biased shaft 46 is controlled by a key that is required to unlock the locking means as shown in FIG. 4. The key when turned rotates a lever to release the rotatable bias shaft 46 so as to allow the rotatable bias shaft 46 to turn for deploying the flexible panel or retracting the flexible panel.

Figure 8:
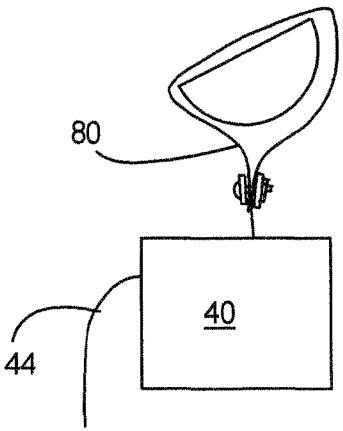
FIG. 8 illustrates connecting the ladder safety device to a rung by straps.

In a second embodiment, a safe ladder 100, FIG. 2, only partially shown, has the container 80 secured to the side rails and is sold as a unit. The elements of the safe ladder 100 are essentially the same as in the first embodiment except there are no top hooks 74 required. A third embodiment is shown in FIG. 6 wherein the container 40 is merged into the structure of a "rung". In a fourth embodiment as shown in FIG. 8, the container 40 may be secured to the ladder permanently by use of a pair of metal straps 80, only one shown in FIG. 8. The straps may be bolted together or riveted such as used with the pulley. The container 40 may be mounted between the rails or behind the rails if attached to the lower rung and the panel may extend upwards instead. The panel would have a width slightly less than the width between the rails.

Since many modifications, variations, and changes in detail can be made to the described embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A ladder safety device, said ladder safety device comprising:

means for connecting said ladder safety device to a ladder, wherein said ladder safety device is used upon an extension ladder and said ladder safety device connects to one or more rungs of the ladder, said means for connecting being hooking means;

a flexible panel;

a container, said container having a traverse slot therein from which said flexible panel is extended or retracted;

a lockable means for controlling said flexible panel, said lockable means mounted in said container, said lockable means having a keyed lock wherein a key is required to unlock said locking means, said locking means preventing said flexible panel from being removed or moved once locked; and a rotatable biased shaft, said rotatable shaft mounted in said container, said flexible panel having one end mounted to said rotatable shaft, said lockable means engaging said rotatable shaft in a predetermined manner, said keyed lock must be released to move said flexible panel when attached, wherein said key when turned rotates a lever which disengages a pivoted biased shaft from said rotatable biased shaft to release said rotatable biased shaft to allow said rotatable biased shaft to turn for deploying said flexible panel or retracting said flexible panel.

2. The ladder safety device of claim 1, when said hooking means comprises a first hooking means mounted on said container, and a second hooking means mounted on said flexible panel on an end opposite to said end mounted to said rotatable shaft.

3. The ladder safety device of claim 2, wherein said first and said second hooking means are hooks.

* * * * *